US005477607A

United States Patent [19]

Ohta et al.

[11] Patent Number: 5,477,607

[45] Date of Patent: Dec. 26, 1995

[54] CONNECTOR HOUSING FEEDING MECHANISM

[75] Inventors: Yoshinobu Ohta; Kenichi Taniguchi, both of Yokkaichi, Japan

[73] Assignee: Sumitomo Wiring Systems, Ltd., Yokkaichi, Japan

[21] Appl. No.: 201,188

[22] Filed: Feb. 24, 1994

[30] Foreign Application Priority Data

Mar. 2, 1993 [JP] Japan ..... 5-041448

[51] Int. Cl.[6] ..... H01R 43/20; H01R 43/04

[52] U.S. Cl. ..... 29/748; 29/33 M; 29/759

[58] Field of Search ..... 29/33 M, 747, 29/748, 749, 759, 760, 861; 414/765, 769

[56] References Cited

U.S. PATENT DOCUMENTS

| | | | |
|---|---|---|---|
| 4,675,995 | 6/1987 | Anderson | 29/861 |
| 4,680,841 | 7/1987 | Schneider et al. | 29/33 M |
| 4,729,152 | 3/1988 | Hammond et al. | 29/33 M |
| 4,970,778 | 11/1990 | den Otter | 29/747 |
| 5,110,255 | 5/1992 | LeBan et al. | 29/759 X |

FOREIGN PATENT DOCUMENTS

| | | | |
|---|---|---|---|
| 63-148582 | 6/1988 | Japan . | |
| 63-123082 | 8/1988 | Japan . | |
| 8905047 | 6/1989 | WIPO | 29/748 |

*Primary Examiner*—Peter Vo

*Attorney, Agent, or Firm*—Beveridge, DeGrandi, Weilacher & Young

[57] ABSTRACT

The present invention relates to a connector housing feeding mechanism capable of rotating a plurality of connector housings around an axis along the direction in which the connector housings are juxtaposed and displacing a group of the connector housings to a predetermined terminal inserting position and housing replacing position.

9 Claims, 4 Drawing Sheets

CONNECTOR HOUSING FEEDING MECHANISM

CROSS REFERENCE TO RELATED APPLICATION

This application claims priority benefits under 35 USC §119 of Japanese Patent Application Serial No. 5-41448, the disclosure of which is incorporated by reference.

BACKGROUND OF THE INVENTION

1. Field of the Invention

The present invention relates generally to a connector housing feeding mechanism, and more particularly, to a connector housing feeding mechanism which can be most suitably used for the terminal inserting process for an electric wire assembly constituting a wiring harness.

2. Description of the Related Art

The manufacturing processes of a wiring harness constructed by assembling a plurality of coated electric wires include the measuring process for measuring and cutting an electric wire, the stripping process for stripping an end of the electric wire, the terminal crimping process for crimping a terminal on a conductor in the end of the stripped electric wire, the terminal connecting process for connecting the electric wire to a connector housing through the terminal, and the like.

The terminal connecting process has been conventionally carried out using a connecting apparatus. Such a connecting apparatus is disclosed in, for example, Japanese Utility Model Unexamined Publication No. 63-123082.

The connecting apparatus in the prior art comprises a terminal inserting mechanism and a housing feeding mechanism. The terminal inserting mechanism cramps an end of an electric wire and a terminal crimped on the end. On the other hand, the housing feeding mechanism carries a lot of connector housings and juxtaposes the connector housings in a horizontal direction. The connecting apparatus sequentially inserts the end of the electric wire and the terminal which are cramped into the connector housings carried by the housing feeding mechanism.

The conventional housing feeding mechanism comprises a housing carrying member for horizontally juxtaposing a plurality of connector housings. The housing carrying member is supported by a supporting member. This supporting member displaces the connector housings carried by the housing carrying member, together with the housing carrying member, to a terminal inserting position. The conventional supporting member is embodied by an index table which is square in plane view. The housing carrying member is mounted on each of the side surfaces of the index table. In this case, the direction in which the connector housings are juxtaposed is a direction along each of the sides, that is, the side surface of the index table. The index table is intermittently rotated for each angle of 90° around a vertical axis. In a first stop position, the connector housing is carried by the housing carrying member. In the subsequent second stop position, the connector housing carried by the housing carrying member waits. In the subsequent third stop position, a terminal is inserted into the connector housing. In the subsequent fourth stop position, the connector housing into which the terminal is inserted is removed from the housing carrying member and gathered.

The rotation of the index table is controlled by so-called teaching work. The teaching work is to input position information of the connector housing into a computer of a controller for each housing carrying member. Because the conventional housing feeding mechanism has four housing carrying members, the teaching work is performed four times.

In the conventional housing feeding mechanism, the index table which is square in plane view is rotated around the vertical axis, that is, an axis intersecting the direction in which the connector housings are juxtaposed. Consequently, the diagonal line of the index table would at least be the diameter with respect to the rotation of the index table. As a result of this, as the larger the number of connector housings and therefore the overall length of the juxtaposed connector housings are, then the greater the inertia that is developed in the index table in a direction in which the index table rotates. Such inertia causes an undue increase in size of the connecting apparatus and consequently in cost.

Furthermore, four housing carrying members corresponding to the respective sides of the index table are required. This causes an increase in cost because the number of jigs disposed in the housing carrying members is large.

Additionally, in the conventional connecting apparatus, the four housing carrying members are employed. Therefore, the teaching work must be performed four times, which takes a lot of time and labor.

Accordingly, what is really needed is an efficient housing feeding mechanism capable of miniaturizing the connecting apparatus.

SUMMARY OF THE INVENTION

The present invention is directed to a housing feeding mechanism that satisfies this need.

A housing feeding mechanism in a preferred mode of the present invention comprises a housing carrying member for juxtaposing connector housings in one direction with predetermined spaces therebetween. The housing carrying member carries each of these connector housings. The present invention comprises means for rotating the housing carrying member around a rotational axis that extends along the direction in which the connector housings are juxtaposed. Consequently, inertia which would develop in the housing carrying member can be decreased at the greatest extent, thereby to make it possible to miniaturize a connecting apparatus as compared with a structure in which the housing carrying member is rotated around the axis intersecting the direction in which the connector housings are juxtaposed. The miniaturization of the connecting apparatus likewise reduces the restriction of the number of connector housings. Consequently, the versatility of the housing feeding mechanism is easily expanded. Further, in a more preferred mode of the present invention, the housing carrying member is rotated by 180°. Therefore, the number of housing carrying members can be decreased to two, thereby to make it possible to reduce teaching work for inputting position information of the connector housing to a computer by half.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
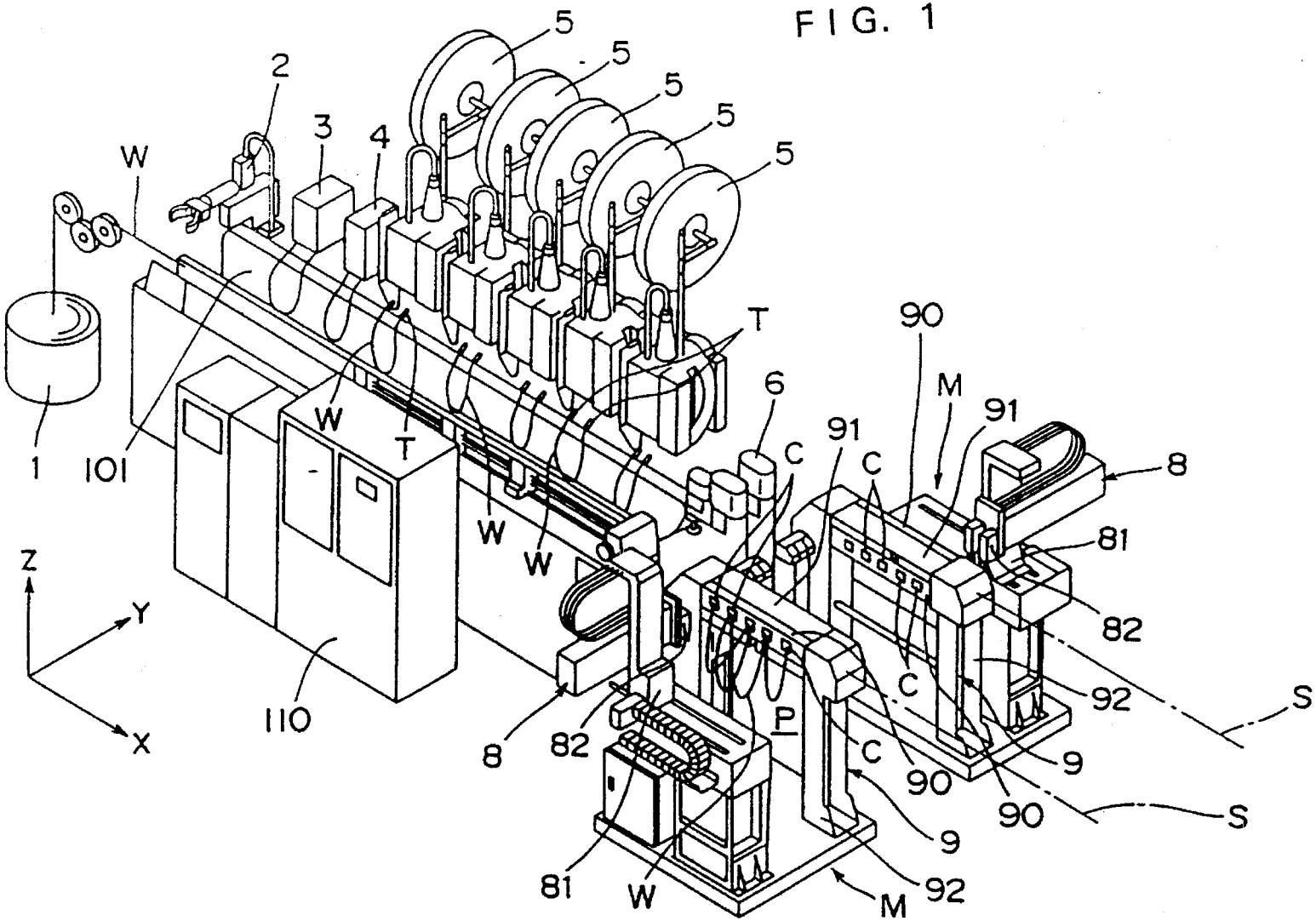
FIG. 1 is a schematic perspective view showing a wiring harness manufacturing apparatus which is equipped with a connecting apparatus according to the present invention.

FIG. 1 is a schematic perspective view showing a wiring harness manufacturing apparatus using a housing feeding mechanism according to the present invention. The wiring harness manufacturing apparatus comprises a measuring device 2 for drawing an electric wire W from an electric wire web 1 to measure and for hanging the electric wire W from a predetermined portion to curve it in a U shape. The measured electric wire W is sequentially conveyed by a conveying device 101. The conveying device 101 carries the wire W upon holding both ends of the electric wire W while hanging an intermediate portion of the electric wire W downwardly. The direction of conveyance of the electric wire W by the conveying device 101 is indicated by X. A stripping device 3 is disposed on the uppermost stream side in the X direction of conveyance. The stripping device 3 is for stripping the end of the electric wire W conveyed by the conveying device 101. A stripping examining device 4 for examining whether or not stripping is good is disposed on the downstream side of the stripping device 3. Terminal crimping devices 5 for selectively crimping a plurality of types of terminals T on a stripped portion of the electric wire W are disposed on the downstream side of the stripping examining device 4. A distributing device 6 for alternately distributing the electric wire W having the terminal T crimped thereon in the lateral direction (hereinafter referred to as the Y direction) perpendicular to the X direction is disposed on the downstream side of the terminal crimping device 5. A pair of connecting apparatus M, each for directly receiving the electric wire W from the distributing device 6, for connecting the terminal T crimped on the electric wire W to a connector housing C is disposed on the downstream side of the distributing device 6 in the X direction.

The connecting apparatuses M symmetrically disposed are opposed to each other in the Y direction. The connecting apparatus M comprises a terminal inserting mechanism 8 and a housing feeding mechanism 9.

Figure 2:
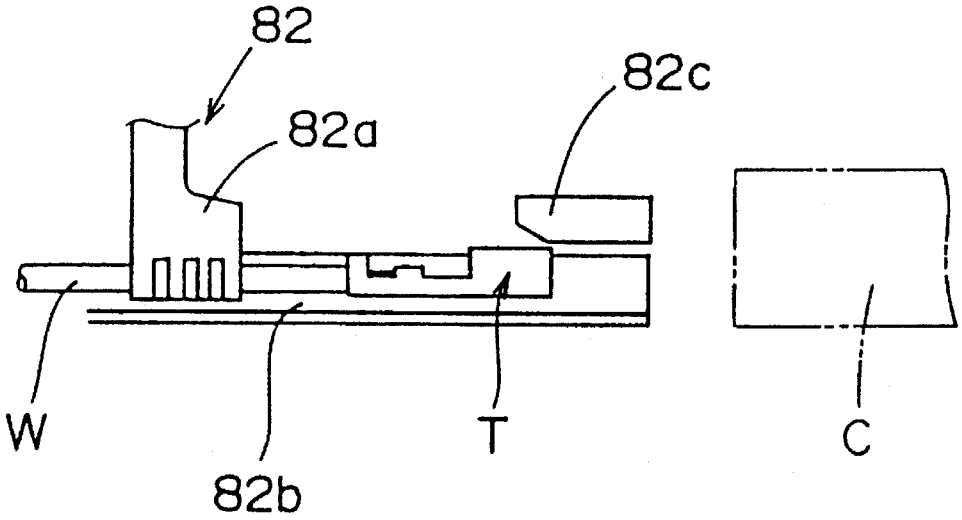
FIG. 2 is a schematic view showing the terminal inserting process.

The terminal inserting mechanism 8 is for inserting the terminal T crimped on the electric wire W into the connector housing C by conveying the electric wire W and the terminal T to a predetermined connector housing C upon cramping the electric wire W and the terminal T distributed by the distributing device 6. The terminal inserting mechanism 8 comprises a moving stand 81 which is movable back and forth in the X direction. A terminal inserting head 82 which is movable in the Y direction and in the vertical direction (the Z direction shown in FIG. 1) is supported on the moving stand 81. The terminal inserting head 82 comprises a pair of electric wire chucks 82*a* shown in FIG. 2. The electric wire chuck 82*a* is for moving the electric wire W and the terminal T in the direction of the connector housing C to insert the terminal T into a predetermined position of the connector housing C, by cramping both ends of electric wire W. The electric wire chuck 82*a* inserts the terminal T in cooperation with two guiding means. The first guiding means is a first terminal inserting guide 82*b* for guiding the insertion through lateral side contact with a side end surface of the terminal T when the terminal T is inserted into the connector housing C. The second guiding means is a second terminal inserting guide 82*c* for guiding the terminal T during insertion through vertical side contact with an upper end surface of the terminal T. The moving stand 81 and the terminal inserting head 82 are controlled by a controller 110 as described later.

Figure 3:
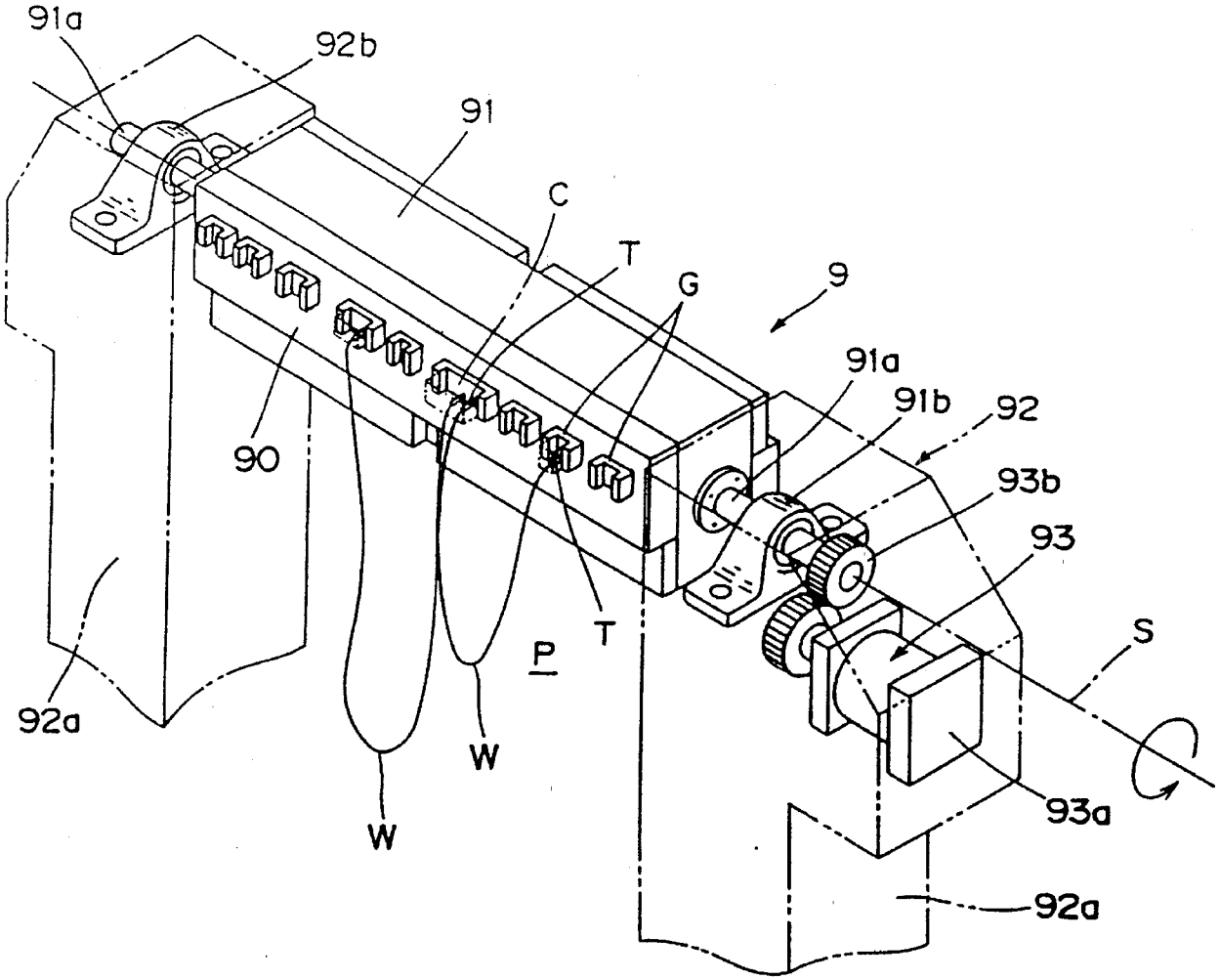
FIG. 3 is a perspective view showing a principal part of a housing feeding mechanism in one embodiment of the present invention.

Referring to FIG. 3, the housing feeding mechanism 9 is for feeding the connector housing C to a terminal inserting position P at which the terminal inserting mechanism 8 is facing thereto. Housing feeding mechanism 9 comprises housing carrying members 90. The housing carrying member 90 is for carrying a plurality of connector housings C which, upon positioning, are spaced with predetermined spaces therebetween along a line extending parallel with horizontal axis S. That is, the housing carrying member 90 carries the plurality of connector housings C. Disposed on the position where each of the connector housings C is carried are a positioning jig G for positioning the connector housing C and a fixing jig (not shown) for fixing the positioned connector housing C. The connector housings C are juxtaposed parallel with the horizontal axis S and are fixed on the housing carrying member 90.

A drawing board supporting member 91 supports the housing carrying members 90. The drawing board supporting member 91 is for supporting the housing carrying members 90 rotatably around the horizontal axis S perpendicular to the direction of insertion of the terminal T (the Y direction). The drawing board supporting member 91 is formed in the shape of an elongated rectangular prism, and supporting shafts 91*a* are projected in both ends thereof. The drawing board supporting member 91 has a front surface facing the terminal inserting position P and a rear surface. The housing carrying members 90 are respectively mounted replaceably to the surfaces while being positioned by a knock pin (not shown) or the like. The terminal inserting position P is the position where the terminal T is inserted by the terminal inserting mechanism 8. In addition, the rear surface faces a housing replacing position D (see FIG. 4). The housing replacing position D is the position where the connector housing C is replaced on the housing carrying member 90. In the present embodiment, both the positions P and D are opposed to each other in the horizontal direction perpendicular to the horizontal axis S. Further, one of the housing carrying members 90 is opposed to the other back to back in the horizontal direction. When one of the housing carrying members 90 faces one of the positions P (D), the other housing carrying member 90 faces the other position D (P). In other words, a pair of the housing carrying members 90 are synchronously opposable to each other. A cylinder (not shown) for driving the fixing jig of the housing carrying member 90 is mounted on the drawing board supporting member 91. Furthermore, the drawing board supporting member 91 is rotatably constituted by a rotational driving mechanism 93. The rotational driving mechanism 93 is controlled by the controller 110 as described later, to rotate the supporting member 91 at every angle of 180° around the horizontal axis S at predetermined timings.

A stationary member 92 carries the drawing board supporting member 91. The stationary member 92 is embodied by a pair of supports 92*a* opposed to each other with a predetermined space therebetween and between which the drawing board supporting member 91 laterally extends. Mounted in the pair of supports 92*a* are bearings 91*b* and 92*b* for rotatably supporting the supporting shafts 91*a* of the drawing board supporting member 91.

The rotational driving mechanism 93 is for transmitting the rotation of a rotary actuator 93*a* to the support 91*a* of the drawing board supporting member 91 through a gear mechanism 93*b*, to drive the drawing board supporting member 91 to rotate by 180°. The drawing board supporting member 91 is automatically rotated in response to inserting work of the terminal T into each of the connector housings C. The drawing board supporting member 91 is positioned by a knock pin which can be inserted or extracted by an air cylinder at every timing of rotation of 180°.

A controller 110 is for controlling the connecting apparatus M together with the measuring device 2, the stripping device 3, the stripping examining device 4, the terminal crimping device 5 and the distributing device 6 shown in FIG. 1. Controller 110 comprises a microcomputer and other electrical equipment.

Furthermore, the controller 110 is also connected to a rotary actuator,or a driving source 93*a* of the rotational driving mechanism 93 for driving the drawing board supporting member 91 to rotate at every angle of 180° as described above in response to operation timing of the terminal inserting mechanism 8.

The control operation of the controller 110 is based on position information of the connector housing C fed to the terminal inserting position P. Teaching work concerning this position information is performed only twice. The reason for this is that the housing feeding mechanism 9 has only two housing carrying members 90 in the present embodiment.

The terminal inserting process is carried out by the following procedure.

Figure 4:
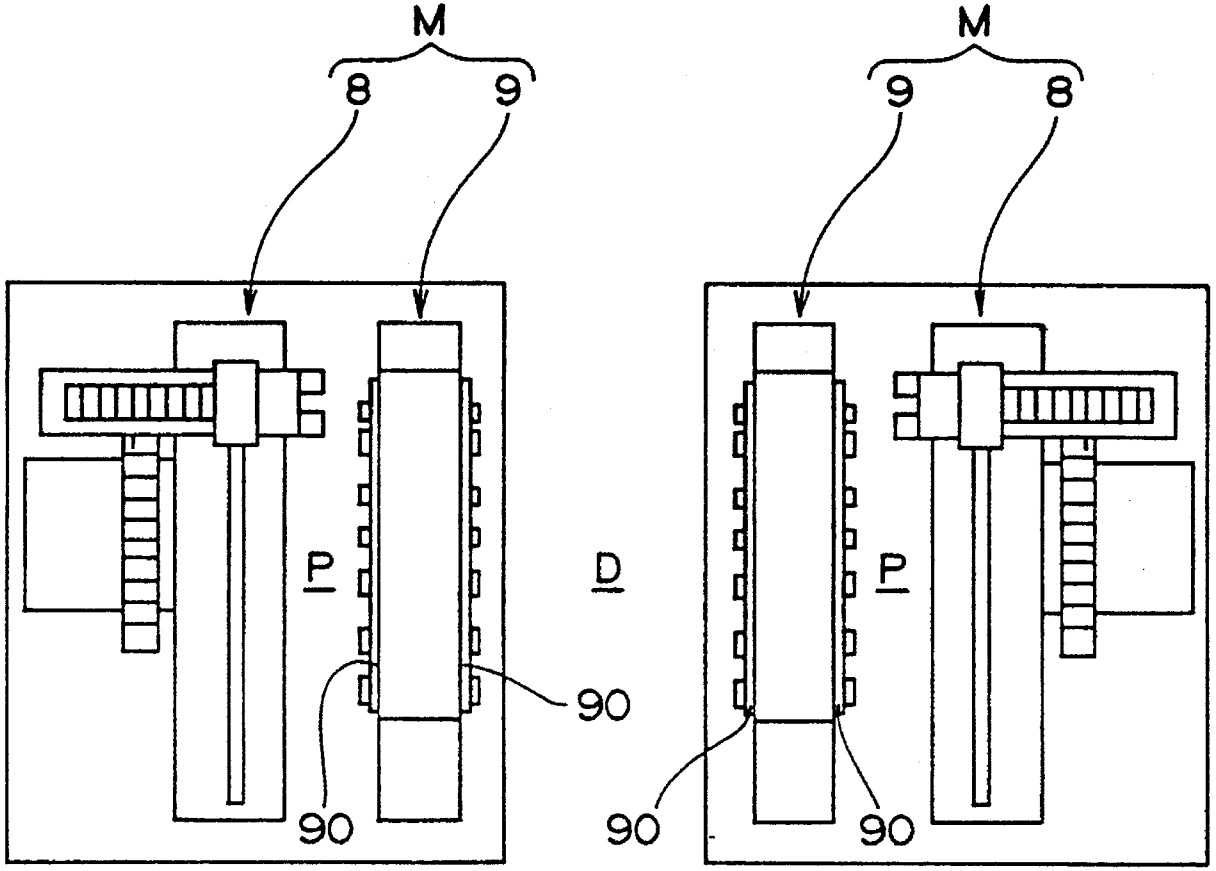
FIG. 4 is a schematic plan view showing a housing feeding mechanism.

First, the connector housing C is carried by the housing carrying member 90 facing the housing replacing position D (see FIG. 4). If this work is terminated, the drawing board supporting member 91 is rotated at an angle of 180°. Similarly, the connector housing C is mounted on the housing carrying member 90 carried by the opposite surface. In this case, the housing carrying member 90 facing the housing replacing position D is displaced to the terminal inserting position P. Accordingly, the inserting work of the terminal T by the terminal inserting mechanism 8 is simultaneously carried out. Specifically, the terminal inserting mechanism 8 repeats to insert sequentially the terminal T into a predetermined connector housing C upon receiving the electric wire W with the terminal T from the distributing device 6. If the mounting work of the connector housing C and the terminal inserting work are terminated, the drawing board supporting member 91 is rotated at an angle of 180° again by the rotational driving mechanism 93. The mounting work is generally terminated earlier than the terminal inserting work. Consequently, the connector housing C after the termination of the terminal inserting work is returned to the housing replacing position D again, while a new connector housing carried in the housing replacing position D faces the terminal inserting position P. The connector housing C, which is returned to the housing replacing position D is removed from the housing carrying member 90 after the termination of the terminal inserting work and then, a new connector housing C is carried by the housing carrying member 90, thereby to make it possible to continuously manufacture electric wires W each having a connector housing C mounted on its end. In the present embodiment, both the housing carrying members 90 are synchronously opposable to the terminal inserting position P or the housing replacing position D. Accordingly, the replacing work of the connector housing C can be performed simultaneously with the terminal inserting work. Furthermore, the housing carrying member 90 is alternatively displaced so as to face both the positions P and D, so that the waiting time is shortened. The mounting work of the connector housing C may be manually performed. Alternatively, an automatic connector housing conveying device can be used.

Since the housing feeding mechanism 9 in the connecting apparatus M is rotated around a rotational axis along the direction in which the connector housings C are juxtaposed by the rotational driving mechanism 93, inertia which would develop in the housing carrying member 90 can be decreased at the greatest extent, thereby to make it possible to miniaturize the connecting apparatus as compared with a structure in which the housing carrying member is rotated around the axis intersecting the direction in which the connector housings C are juxtaposed. The miniaturization of the connecting apparatus also reduces the restriction of the number of connector housings C which can be carried. Consequently, the versatility of the housing feeding mechanism 9 is easily expanded. In other words, the housing carrying member 90 is replaced, thereby to make it possible to manufacture a lot of types of wiring harnesses using one housing feeding mechanism 9.

Moreover, the housing carrying member 90 is rotated at every angle of 180° around the horizontal axis S to carry the connector housings C supported by the two housing carrying members 90. Consequently, the amount of housing carrying member 90 can be reduced by half, as compared with the housing feeding mechanism employing the conventional square index table. Therefore, the man-hour of the teaching work for inputting the position information of the connector housing C fed to the terminal inserting position P to the computer may be half of the conventional man-hour.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A connector housing feeding mechanism for manufacturing a wiring harness, comprising:

housing carrying means for replaceably carrying a plurality of connector housings to juxtapose the connector housings along one horizontal direction perpendicular to a direction of terminal insertion;

stationary means which allows the housing carrying means to be rotated around an axis of rotation extending along the one horizontal direction, for supporting the juxtaposed connector housings so as to be displaceable to a terminal inserting position for inserting a terminal and a housing replacing position for replacing the connector housings; and displacing means for alternately displacing the housing carrying means supported on the stationary means to the terminal inserting position and the housing replacing position at predetermined timings.

2. A connector housing feeding mechanism according to claim 1, wherein the housing carrying means has a pair of housing carrying members with a first of said housing carrying members being in the terminal insertion position when a second of said housing carrying members is in the housing replacing position, and said second housing carrying member being in the terminal inserting position and said first housing carrying member being in a housing replacing position upon said displacing means displacing the housing carrying means.

3. A connector housing feeding mechanism according to claim 2, wherein said first and second housing carrying members are positioned such that terminal insertion and housing replacement occurs along a direction that is perpendicular to the axis of rotation and which lies with said axis of rotation in a common horizontal plane.

4. A connector housing feeding mechanism according to claim 2, further comprising control means for controlling the displacing means such that each housing carrying member is sequentially displaced between said terminal inserting position and said housing replacing position at a timed interval.

5. A wiring harness manufacturing assembly, comprising:

a connector housing feeding mechanism which includes;

housing carrying means for replaceably carrying a plurality of connector housings to juxtapose the connector housings along one horizontal direction perpendicular to a direction of terminal insertion;

stationary means which allows the housing carrying means to be rotated around an axis of rotation extending along the one horizontal direction, and for supporting the juxtaposed connector housings so as to be displaceable to a terminal insertion position for inserting a terminal and a housing replacing position for replacing the connector housings; and displacing means for alternately displacing the housing carrying means supported on the stationary means to the terminal inserting position and the housing replacing position at predetermined timings; and a terminal insertion member which includes a terminal insertion head which is adjustable in the direction of terminal insertion for inserting terminals that are fixed to ends of wires and supported by said terminal insertion head into connector housings that are supported by said housing carrying means and are in a terminal inserting position.

6. A wiring harness manufacturing assembly, as recited in claim 5, further comprising:

a wire measuring and cutting device for measuring and cutting wire that is free of attached terminals;

a conveyor device for conveying measured and cut wires;

a stripping device which receives measured and cut wires conveyed by said conveyor device and strips ends of the wires;

a terminal crimping device, which receives stripped wires from the conveying device, for crimping terminals onto the stripped wires;

a distributing device which receives wires with crimped terminals thereon from said conveying device and distributes the wires with crimped terminals to said terminal insertion member.

7. A connector housing feeding mechanism for manufacturing a wiring harness, comprising:

a drawing board supporting member elongated along a longitudinal axis;

a housing carrying member supported by said drawing board supporting member, said housing carrying member having a plurality of connector housing positioning jigs which are in a spaced, juxtaposed arrangement along the longitudinal axis, said jigs being dimensioned for receiving connector housings, and said longitudinal axis being perpendicular to a direction of insertion of terminals into the connector housings when supported by said jigs;

a pair of shaft sections extending along the longitudinal axis with a first of said shaft sections extending from a first end of said drawing board supporting member and a second of said shaft sections extending from a second end of said drawing board supporting member;

a first support member rotatively supporting said first shift section and a second support member rotatively supporting said second shaft section such that said drawing board supporting member has a pivot axis in common with the longitudinal axis; and a driving mechanism for rotating said drawing board supporting member and the housing carrying member supported thereon between a terminal inserting position and a connector housing replacing position.

8. A connector housing feeding mechanism according to claim 7, further comprising:

control means for controlling the driving mechanism such that said housing carrying member is displaced by 180° between the terminal inserting position and the housing replacing position.

9. A connector housing feeding mechanism according to claim 7, further comprising:

a second housing carrying member and both of said housing carrying members being releasably supported by said drawing board supporting member, and said drawing board supporting member having first and second side walls that are spaced apart and in a parallel relationship, and one of said housing carrying members being attached to said first side wall and the other of said housing carrying members being attached to said second side wall.

* * * * *